US008006919B2

(12) United States Patent
Renquist et al.

(10) Patent No.: US 8,006,919 B2
(45) Date of Patent: Aug. 30, 2011

(54) SPRINKLER WITH DUAL SHAFTS

(75) Inventors: Steven C. Renquist, Chino Hills, CA (US); Peter Janku, Temecula, CA (US); Richard C. McClure, Placentia, CA (US); Saroj Manandhar, Chino Hills, CA (US)

(73) Assignee: The Toro Company, Bloomington, MN (US)

( * ) Notice: Subject to any disclaimer, the term of this patent is extended or adjusted under 35 U.S.C. 154(b) by 145 days.

(21) Appl. No.: 12/210,085

(22) Filed: Sep. 12, 2008

(65) Prior Publication Data

US 2009/0072048 A1 Mar. 19, 2009

Related U.S. Application Data

(60) Provisional application No. 61/012,202, filed on Dec. 7, 2007, provisional application No. 60/972,612, filed on Sep. 14, 2007.

(51) Int. Cl.
*B05B 3/04* (2006.01)

(52) U.S. Cl. ..... 239/240; 239/206; 239/222.17; 239/237; 239/457; 239/523

(58) Field of Classification Search ..... 239/205, 239/206, 237, 240, 222.17, 498, 518, 521, 239/523, 451, 457

See application file for complete search history.

(56) References Cited

U.S. PATENT DOCUMENTS 4,579,285 A * 4/1986 Hunter ..... 239/457
4,681,259 A 7/1987 Troup et al.
4,784,325 A 11/1988 Walker et al.
4,842,201 A 6/1989 Hunter
4,867,379 A 9/1989 Hunter
4,898,332 A 2/1990 Hunter et al.
4,967,961 A 11/1990 Hunter
5,058,806 A 10/1991 Rupar
RE33,823 E 2/1992 Nelson et al.
5,148,990 A 9/1992 Kah, Jr.
5,288,022 A 2/1994 Sesser
5,556,036 A 9/1996 Chase
6,019,295 A * 2/2000 McKenzie ..... 239/451
6,135,364 A 10/2000 Nickish
6,145,758 A * 11/2000 Ogi et al. ..... 239/457
6,244,521 B1 6/2001 Sesser
6,264,117 B1 * 7/2001 Roman ..... 239/451
6,499,672 B1 12/2002 Sesser
6,651,905 B2 11/2003 Sesser et al.
6,688,539 B2 2/2004 Vander Griend
6,736,332 B2 5/2004 Sesser et al.
6,814,304 B2 11/2004 Onofrio
6,883,727 B2 4/2005 De Los Santos
6,942,164 B2 9/2005 Walker
(Continued)

*Primary Examiner* — Steven J Ganey
(74) *Attorney, Agent, or Firm* — Inskeep IP Group, Inc.

(57) ABSTRACT

In a preferred embodiment of the present invention a sprinkler is provided, having a first shaft coupled to a drive mechanism and a grooved deflector. A second shaft is disposed within the first shaft, coupled to a water flow adjustment mechanism and an adjustment region on the top of the deflector. The first shaft transfers rotational movement from the drive mechanism to a grooved deflector on the top of the sprinkler. The second shaft rotates with the first shaft during normal operation due to a friction clutch within the sprinkler. When the user desires to adjust the water flow (i.e., the radius of the water), the friction of the clutch can be overcome by rotating the second shaft, increasing openings of flow passages within the sprinkler body. In this respect, flow adjustments can be made from the top of the sprinkler while the deflector rotates.

23 Claims, 24 Drawing Sheets

U.S. PATENT DOCUMENTS

| | | | |
|---|---|---|---|
| 7,032,836 | B2 | 4/2006 | Sesser et al. |
| 7,086,608 | B2 | 8/2006 | Perkins |
| 7,100,842 | B2 | 9/2006 | Meyer et al. |
| 7,143,957 | B2 | 12/2006 | Nelson |
| 7,159,795 | B2 | 1/2007 | Sesser et al. |
| 2002/0139868 | A1 | 10/2002 | Sesser et al. |
| 2007/0012800 | A1 | 1/2007 | McAfee et al. |
| 2008/0308650 | A1 | 12/2008 | Clark |

* cited by examiner

SPRINKLER WITH DUAL SHAFTS

RELATED APPLICATIONS

The present invention claims priority to U.S. Provisional Patent Application Ser. No. 61/012,202 filed Dec. 7, 2007 entitled Sprinkler with Dual Shafts, and U.S. Provisional Application Ser. No. 60/972,612 filed Sep. 14, 2007 entitled Mini Stream Sprinkler, the contents of all of which are incorporated herein by reference.

BACKGROUND OF THE INVENTION

Rotating stream sprinklers, also known as mini stream sprinklers, deliver a plurality of rotating streams to the surrounding terrain. The streams are achieved by directing water against a rotatable deflector plate having a plurality of vanes on its lower surface. As the deflector plate rotates, these streams move within a predetermined watering arc set by the user.

The plurality of streams that emanate from the sprinkler provide a visually appealing water dispersal. Additionally, the plurality of streams provides greater wind resistance and more uniform distribution to the surrounding turf.

Due to their often small size, the watering arc and watering radius settings of the rotating stream sprinklers can be difficult to adjust. Further, the rotatable deflectors of most prior art rotating stream sprinklers are driven by the force of water striking angled surfaces on the deflector. Hence, it can be difficult to control the speed of rotation of the deflector plate.

Examples of mini stream sprinklers can be seen in U.S. Pat. Nos. 5,148,990; Re 33,823; 4,842,201; 4,898,332; 4,867,379; 4,967,961; 5,058,806; 5,288,022; 6,135,364; 6,244,521; 6,499,672; 6,651,905; 6,688,539; 6,736,332; 6,814,304; 6,883,727; 6,942,164; 7,032,836; 7,086,608; 7,100,842; 7,143,957; and 7,159,795; the contents of all of these patents are hereby incorporated by reference.

SUMMARY OF THE INVENTION

In a preferred embodiment of the present invention a sprinkler is provided, having a first shaft coupled to a drive mechanism and a grooved deflector. A second shaft is disposed within the first shaft, coupled to a water flow adjustment mechanism and an adjustment region on the top of the deflector. The first shaft transfers rotational movement from the drive mechanism to a grooved deflector on the top of the sprinkler. The second shaft rotates with the first shaft during normal operation due to a friction clutch within the sprinkler. When the user desires to adjust the water flow (i.e., the radius of the water), the friction of the clutch can be overcome by rotating the second shaft, increasing openings of flow passages within the sprinkler body. In this respect, flow adjustments can be made from the top of the sprinkler while the deflector rotates.

DETAILED DESCRIPTION OF THE INVENTION

Figure 1:
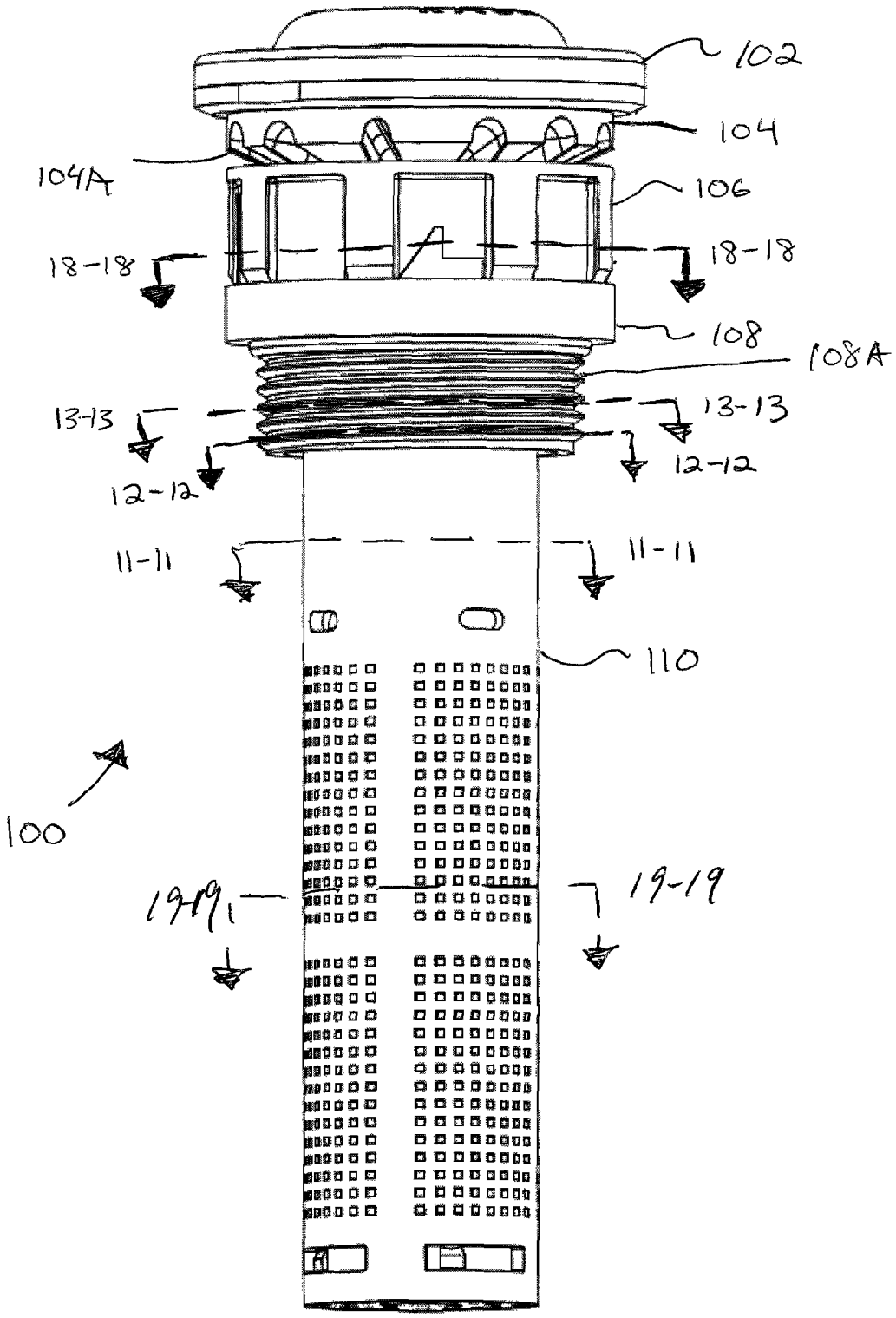
FIG. 1 illustrates a side view of a sprinkler according to a preferred embodiment of the present invention.
Figure 2:
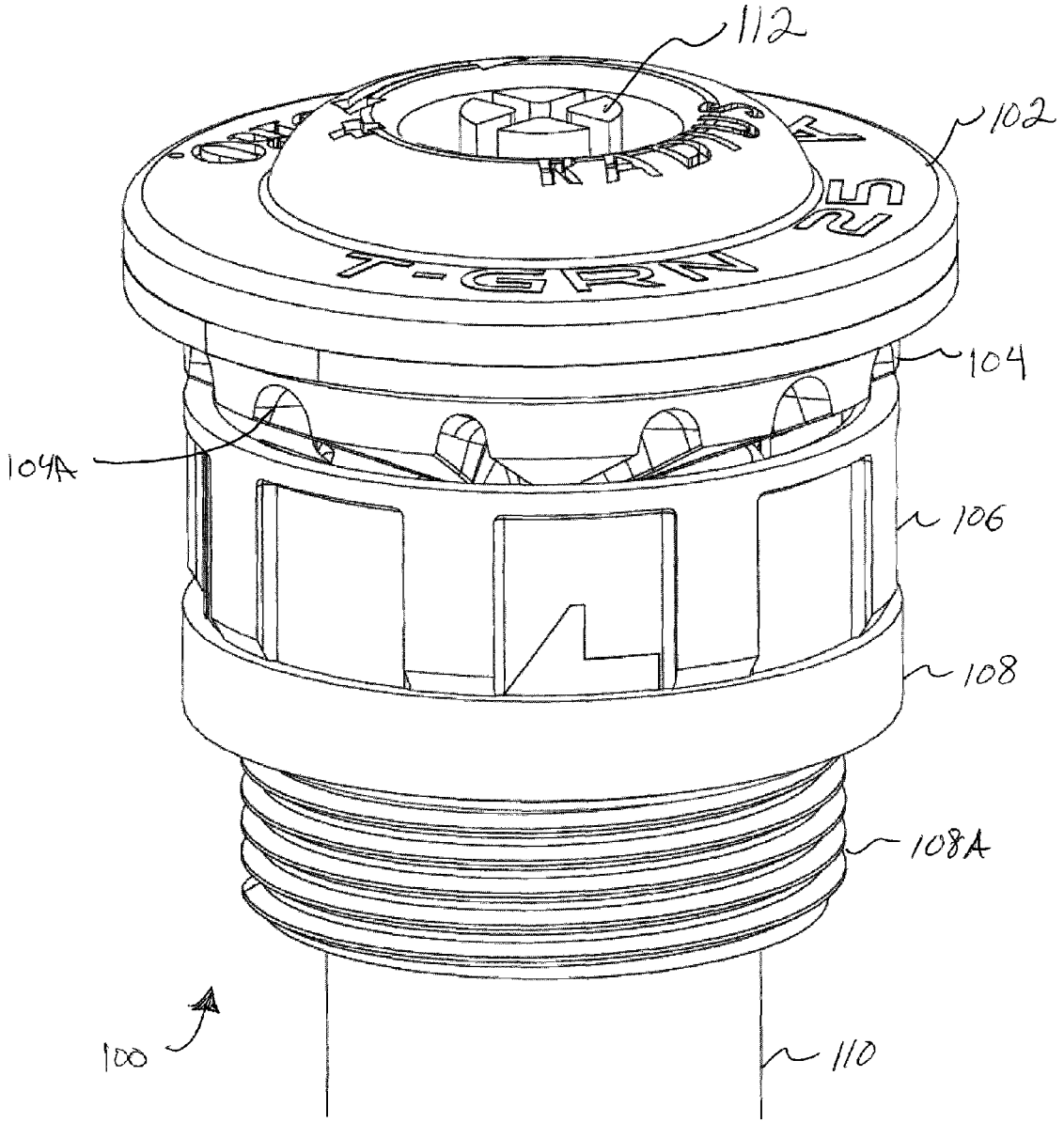
FIG. 2 illustrates a perspective view of the sprinkler of FIG. 1.

FIGS. 1 and 2 illustrate a rotating stream sprinkler 100 according to the present invention. The sprinkler 100 includes a grooved deflector plate 104 that distributes water streams from channels 104A while rotating. The sprinkler arc is adjusted by rotating arc adjustment member 106 and the flow (i.e., the distance or radius of the water flow) is adjusted by rotating the flow adjustment member 112 at the top cover 102. The outer base member 108 includes a thread 108A for screwing into an appropriate sprinkler riser to mount the sprinkler 100. Note that while the thread 108A faces outward from the sprinkler 100 (a male fitting), other thread orientations are possible such as an inwardly facing thread (female fitting).

Figure 3:
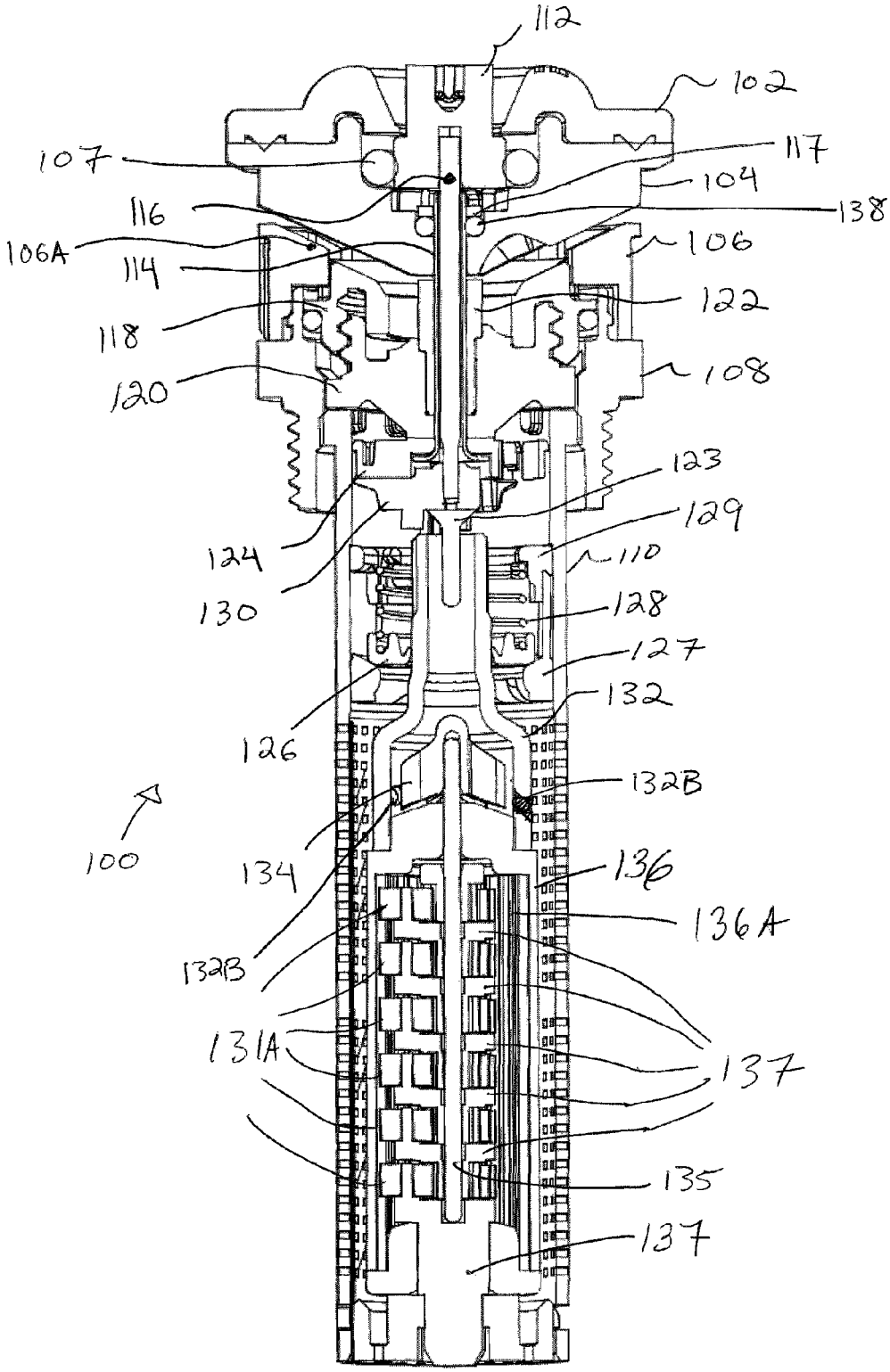
FIG. 3 illustrates a cross sectional view of the sprinkler of FIG. 1.
Figure 4:
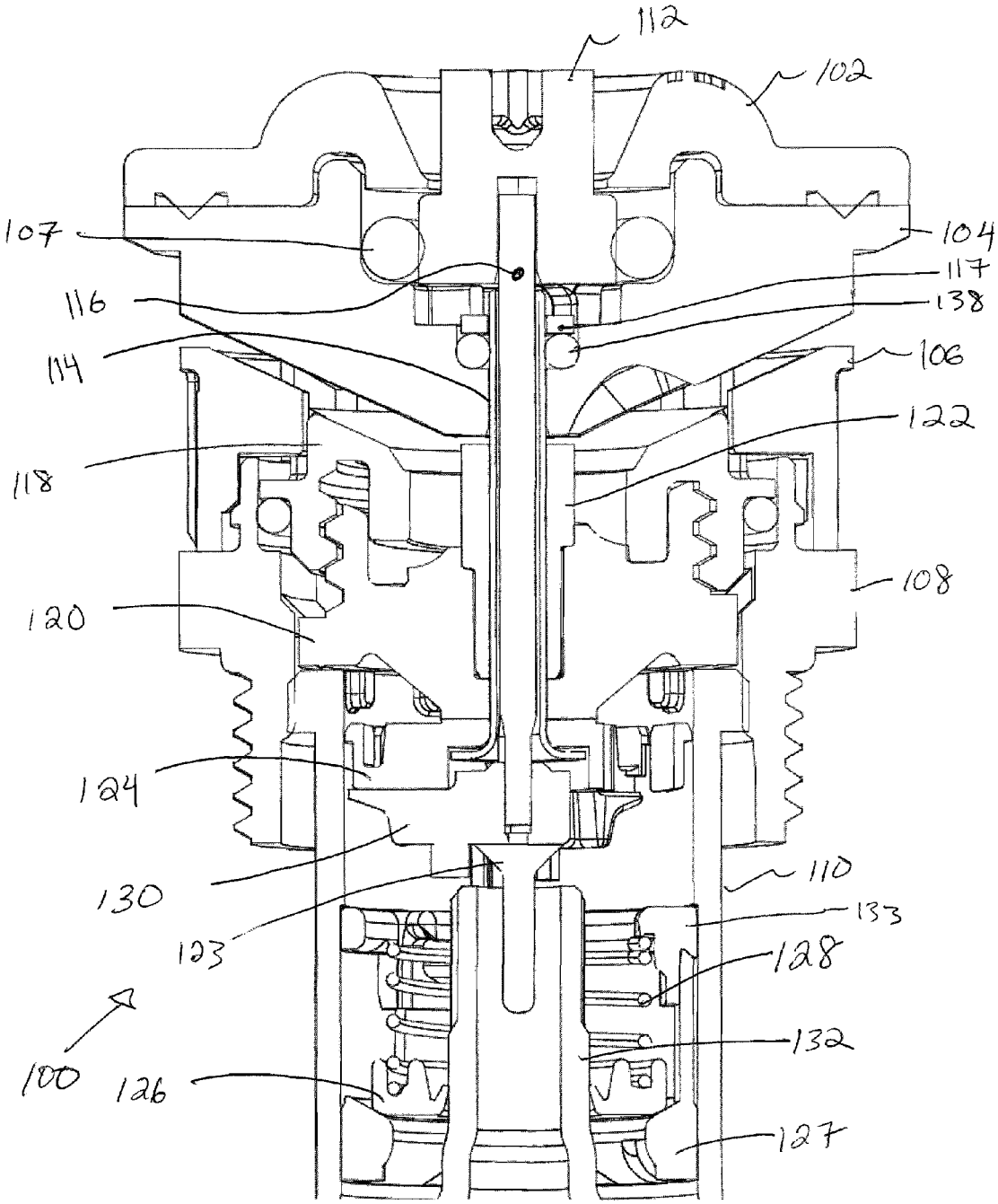
FIG. 4 illustrates an enlarged cross sectional view of the sprinkler of FIG. 1.
Figure 5:
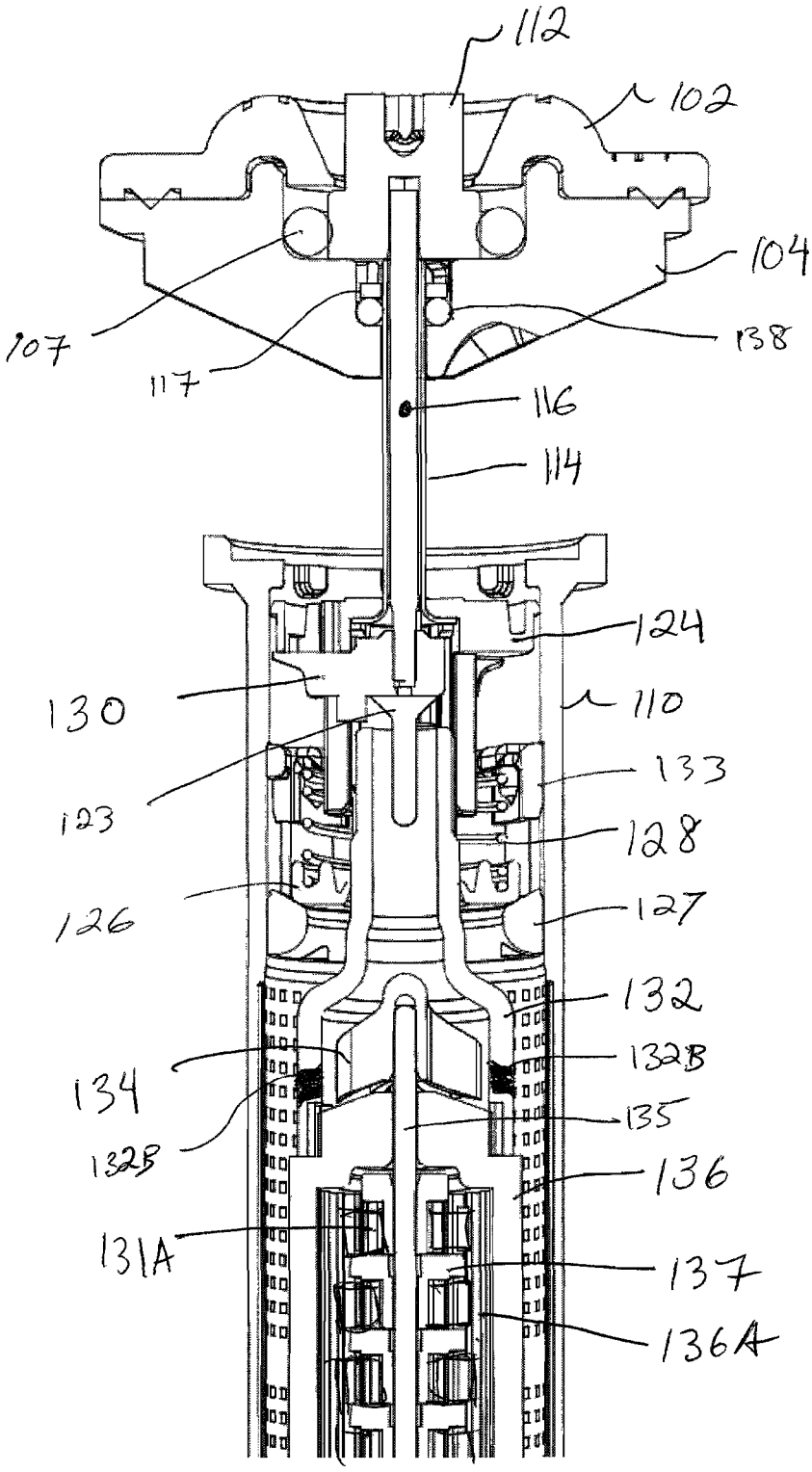
FIG. 5 illustrates a cross sectional view of the sprinkler of FIG. 1 with the arc adjustment assembly removed.
Figure 6:
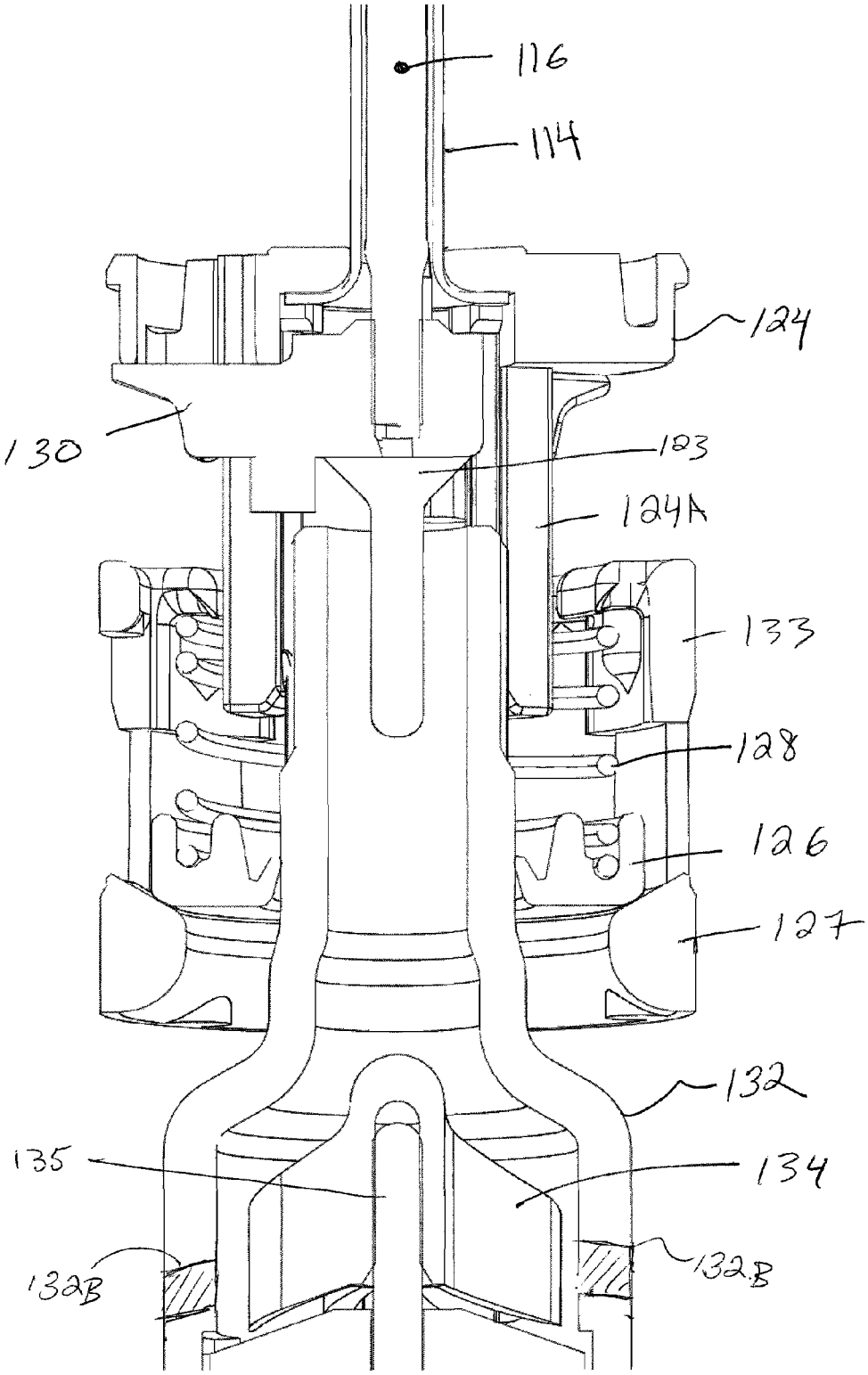
FIG. 6 illustrates an enlarged cross sectional view of a flow adjustment mechanism of the sprinkler of FIG. 1.
Figure 7:
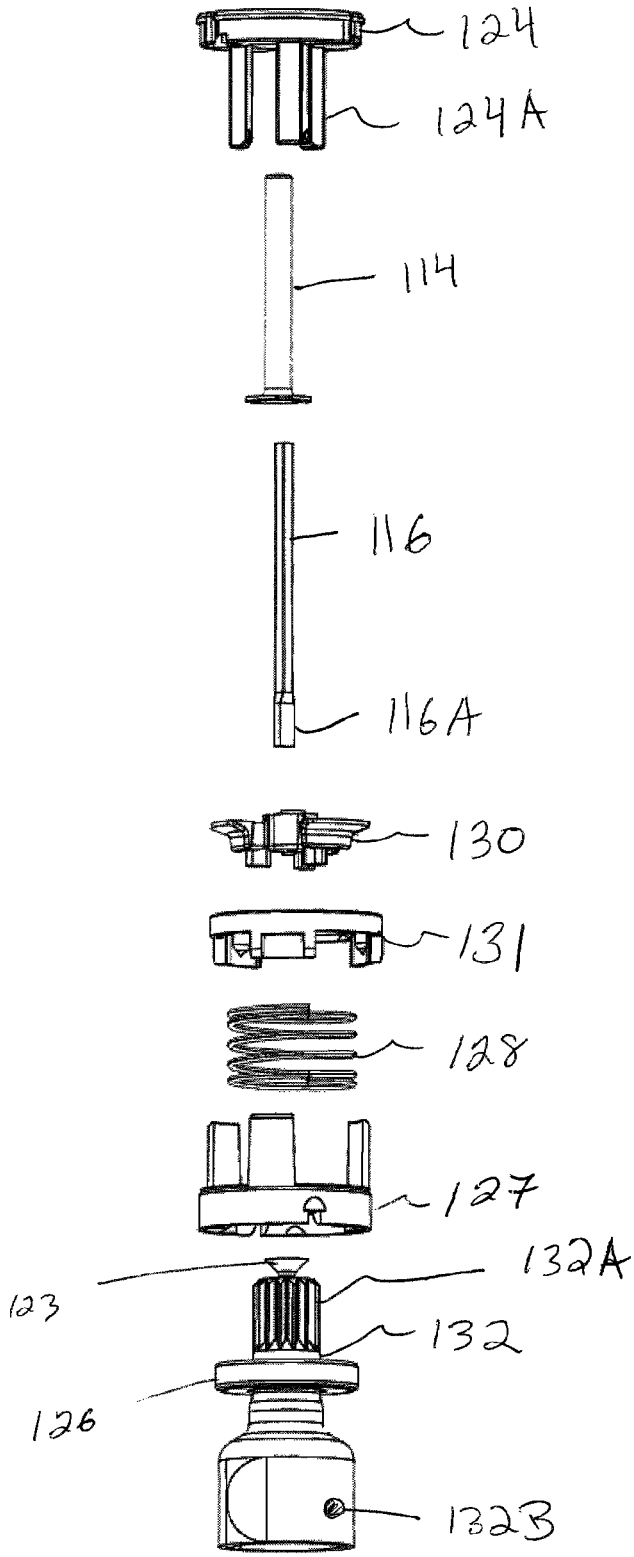
FIG. 7 illustrates an exploded view of the flow adjustment mechanism of FIG. 6.
Figure 8:
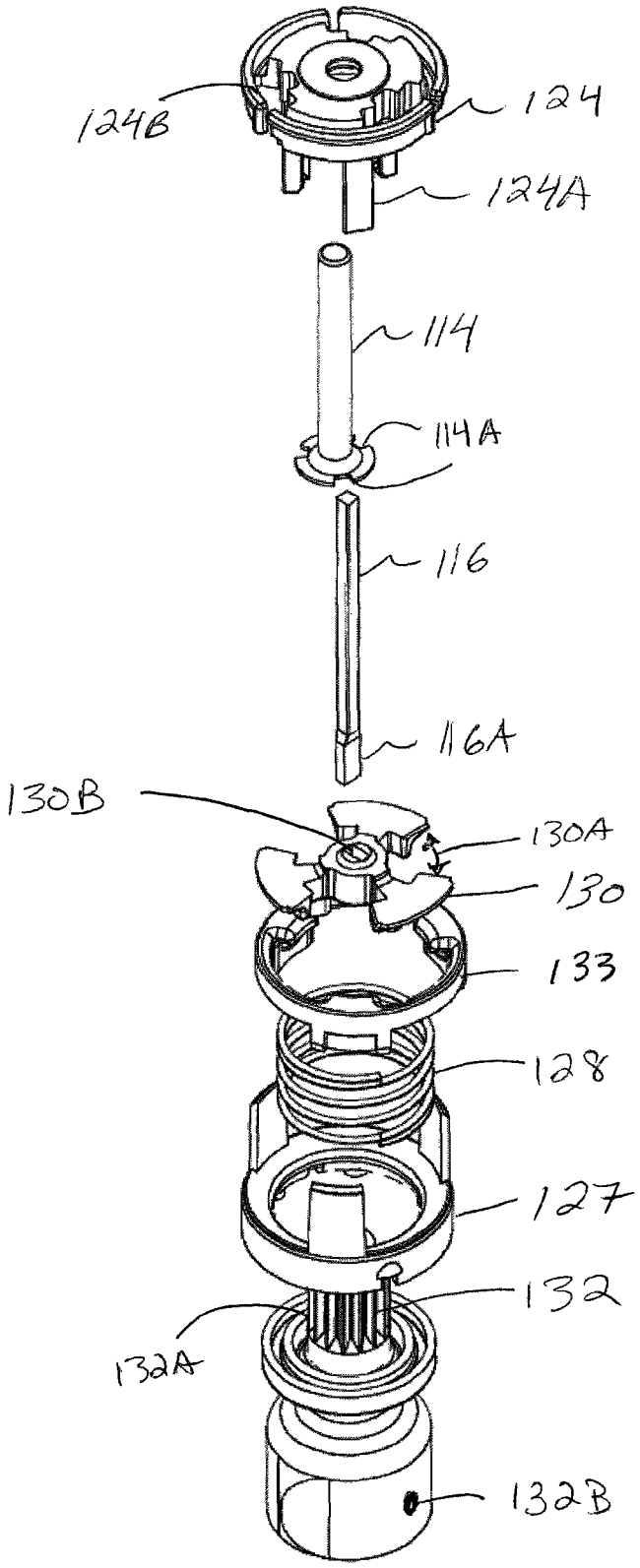
FIG. 8 illustrates an exploded perspective view of the flow adjustment mechanism of FIG. 6.
Figure 9A:
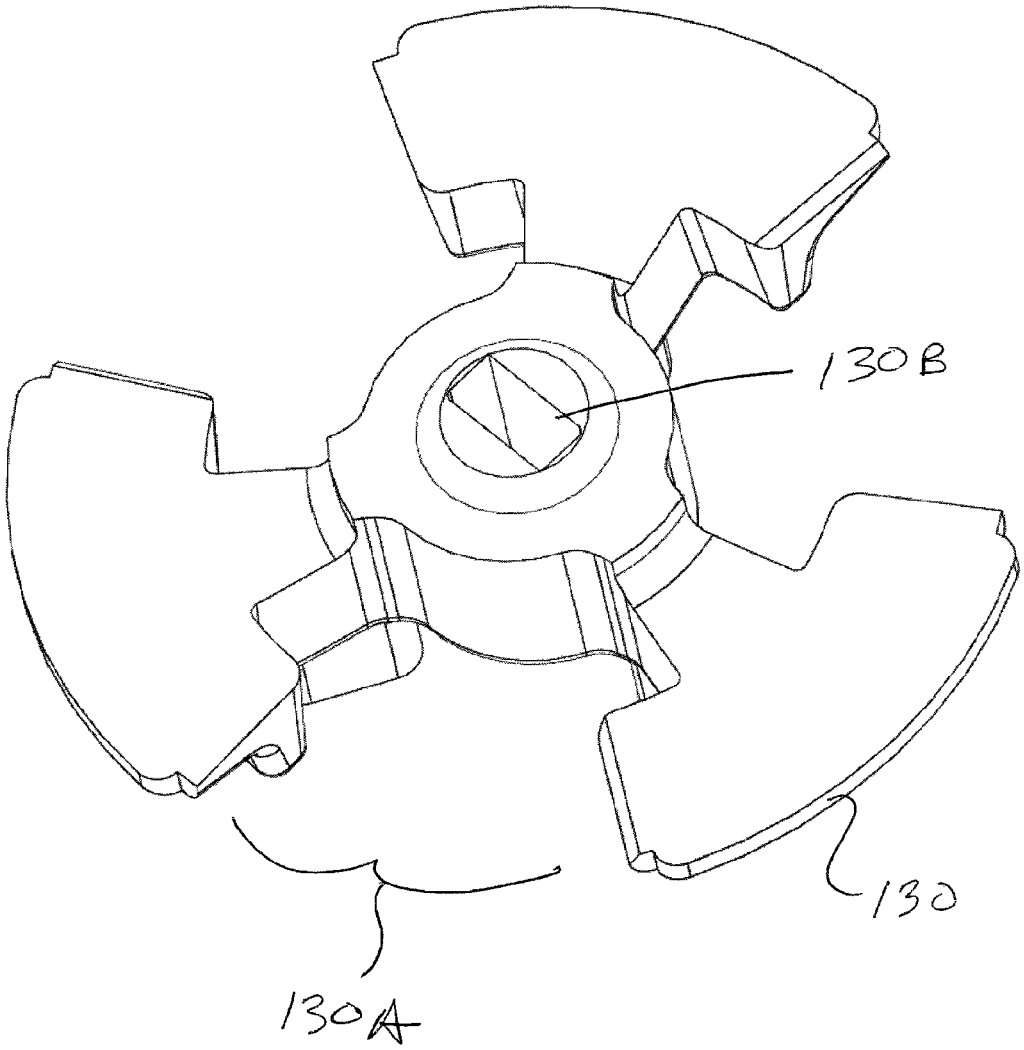
FIG. 9A illustrates a top perspective view of a flow adjustment plate according to a preferred embodiment of the present invention.
Figure 9B:
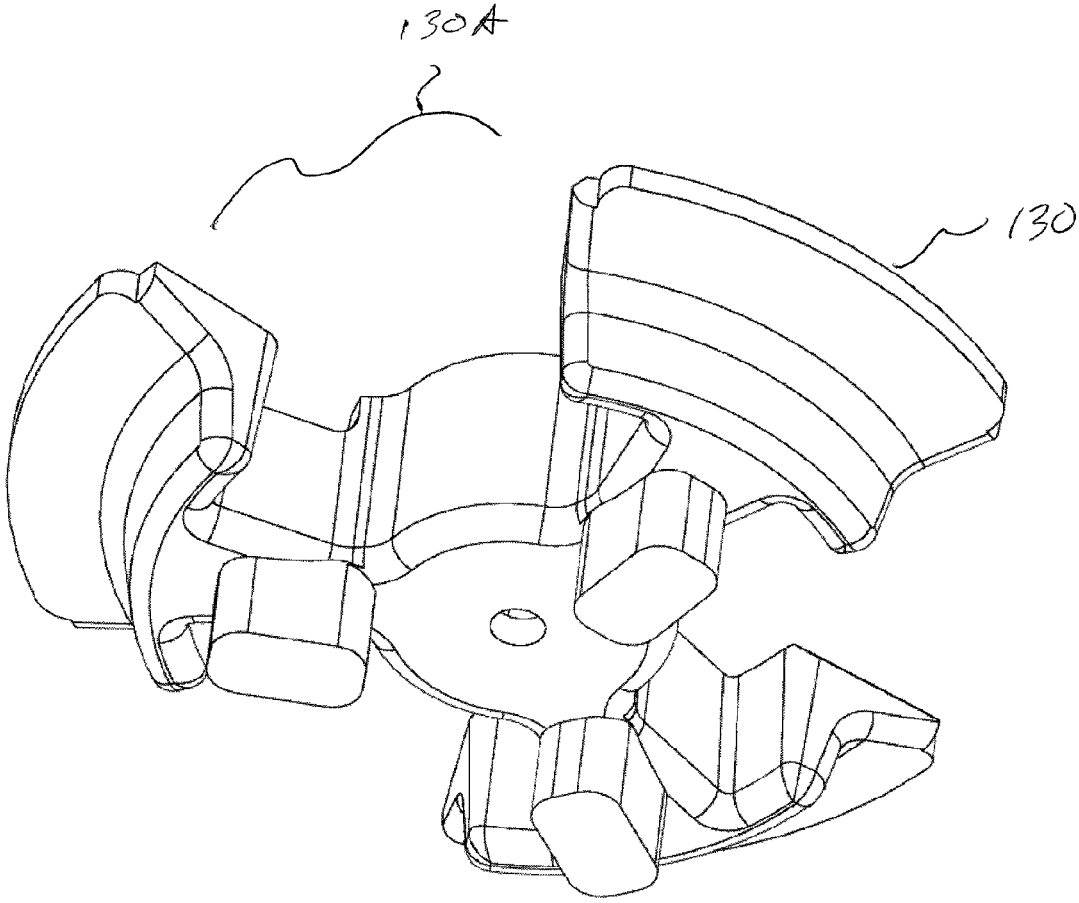
FIG. 9B illustrates a bottom perspective view of the flow adjustment plate of FIG. 9A.
Figure 10:
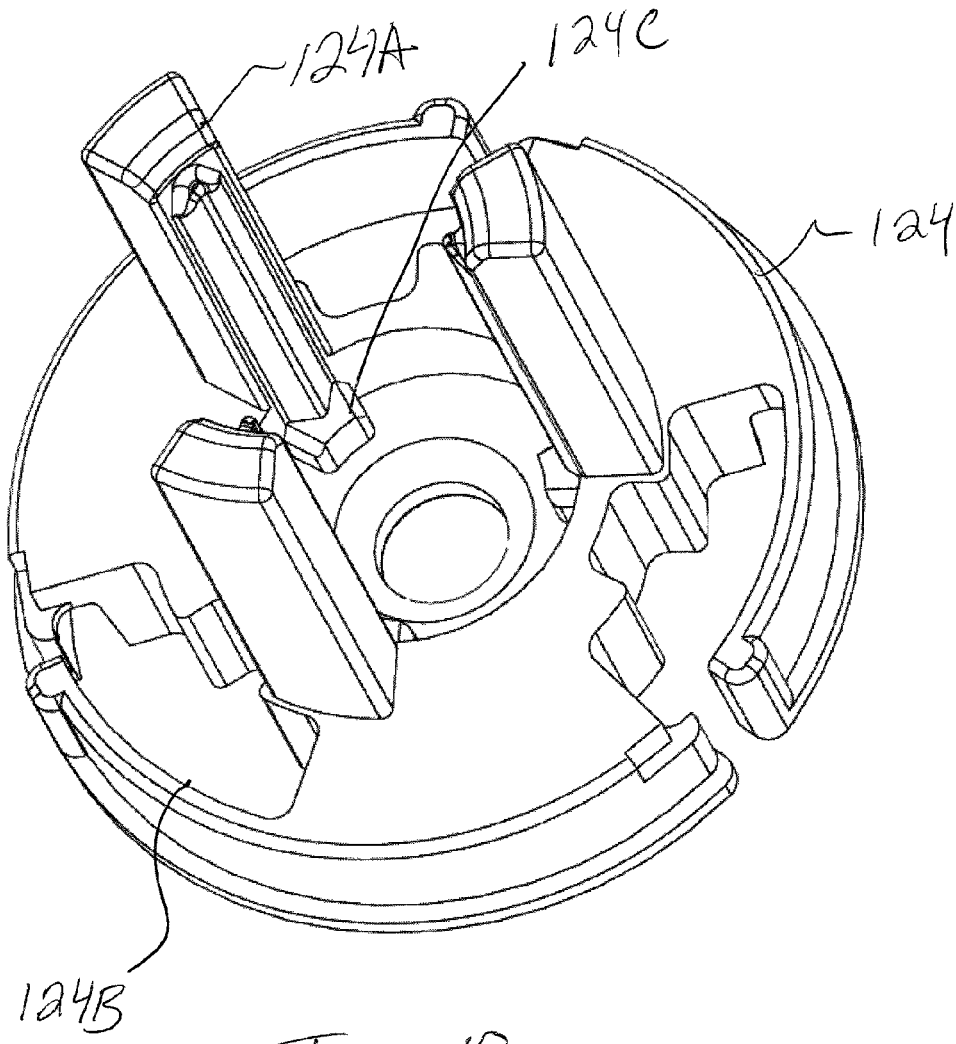
FIG. 10 illustrates a bottom perspective view of a rotational drive plate according to a preferred embodiment of the present invention.
Figure 11:
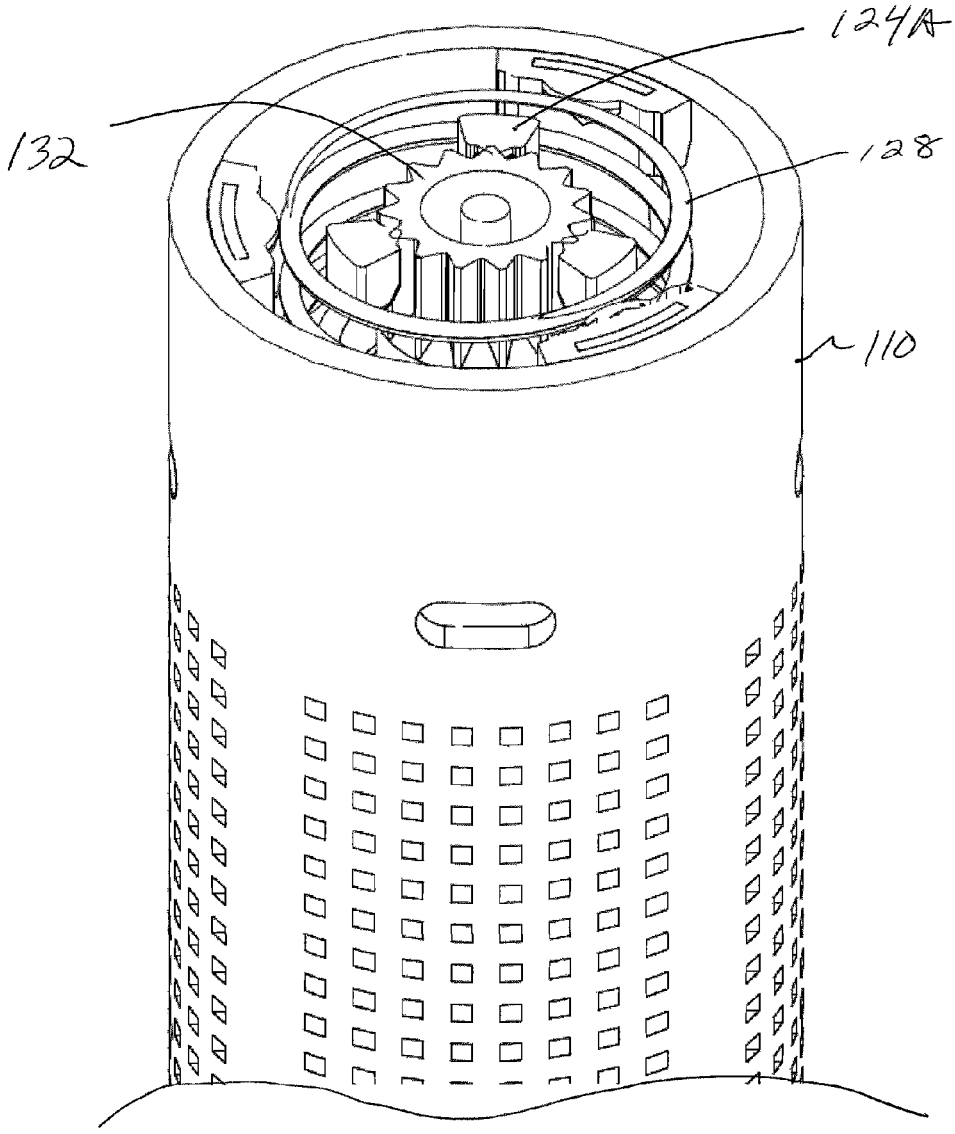
FIG. 11 illustrates a cross sectional view of the sprinkler of FIG. 1 along lines 11-11.

As seen in the cross sectional views of FIGS. 3-5, the sprinkler 100 includes a drive shaft 114 that drives rotational movement of the deflector plate 104 and a flow adjustment shaft 116 that adjusts the flow adjustment mechanism.

The drive shaft 114 includes a passage extending through its body and terminating at each end of the shaft 114. The passage is sized to contain the flow adjustment shaft 116 which is positioned within the passage. As will be described in greater detail below, this dual shaft design allows the flow adjustment shaft 116 to rotate with the drive shaft 114 during normal operation. However, during adjustment of the flow (i.e., radius), the flow adjustment shaft 116 can rotate relative to the drive shaft 114 to adjust water flow without stopping rotational movement of the deflector plate 104.

Referring to FIG. 4 and FIG. 5 (lacking the arc adjustment assembly for clarity), a top end of the flow adjustment shaft 116 is fixed to flow adjustment member 112. However, the top cover 102 and the deflector plate 104 are not fixed (but may be in contact, for example via O-ring 107) to either the shaft 116 or the adjustment member 112. Hence, the shaft 116 or the adjustment member 112 can rotate independently of the deflector plate 104 and the top cover 102.

As best seen in FIGS. 3, 5, 6 and FIG. 19, the sprinkler 100 is driven by a turbine 134 and gearbox 136. Water flows around the gearbox 136 and into openings 132B on the side surface of the stator 132, causing the turbine 134 to rotate gear shaft 135 and thereby drive the gears 131 within the gearbox 136. Preferably, the openings 132B are directed at an angle tangent to the turbine 132B so as to direct incoming water against the fins of the turbine 134. Since the turbine 134 is located at the top of the gearbox 136, mostly enclosed by the stator 132, the water directed to the turbine 134 can be better controlled or limited. Therefore the turbine speed can be better controlled than if the turbine 134 was located at the bottom of the gearbox 136 as in many prior art designs.

A center gear framework 137 is coupled to the gears 131 within the gearbox 136 and is fixed from rotation to a bottom portion of the sprinkler 100. The rotating gear shaft is fixed to a plurality of drive gears 131B, which are each engaged with gears 131A. The gears 131A are also engaged with an inner geared surface 136A of the gearbox 136. Therefore, when the turbine 134 rotates, the outer case of the gearbox 136 rotates. Since the gearbox 136 is also coupled to a stator 132, the stator 132 similarly rotates.

As best seen in FIG. 3, the speed of the turbine 134 is regulated by a bypass valve that includes a plunger 126. The plunger 126 is spring biased by spring 128 (disposed against spring retainer 129) and seals against stationary member 127. As water flow moves through the sprinkler 100, all of the water passes through openings 132B in the stator 132 (preferably at least 2 openings 132B). As the water flow increases in pressure, it pushes the biased plunger 126 upwards, thereby bypassing the openings 132B and the turbine 134. As pressure further increases, the plunger 126 opens an increasing amount, allowing more water to circumvent the turbine. In this respect, the biased plunger 126 provides a variable bypass valve that helps regulate water flow at the turbine 134 and therefore ultimately the rotational speed of the grooved deflector plate 104.

Turning to FIGS. 6-8 and 10, a drive plate 124 connects the stator 132 with the drive shaft 114. The underside of the drive plate 124 includes legs 124A which are positioned adjacent the top of the stator 132 and thereby engage the geared outer diameter 132A (seen best in FIG. 7) of the stator 132. Similarly, the underside of the drive plate 124 engages a lower end of the drive shaft 114 (e.g., by interlocking structures 124C and 114A or adhesives). In this respect, the rotational movement of the turbine 134 and gearbox 134 is translated to the deflector plate 104 via the drive plate 124 and the drive shaft 114.

As previously discussed, the flow adjustment mechanism adjusts the flow of water through the sprinkler 100 and is best seen in FIGS. 6-13. When the flow is not being adjusted by the user, the flow adjustment mechanism rotates with the drive shaft 114, drive plate 124 and deflector plate 104. When the user adjusts the flow, the flow adjustment mechanism rotates relative to the drive shaft 114, drive plate 124 and deflector plate 104.

The water flow through the sprinkler 100 is adjusted by aligning spaces or apertures 130A formed by the throttle plate 130 with apertures 124B in the drive plate 124. The cross sectional view of FIGS. 12 and 13 best illustrate the alignment of these apertures 130A and 124B. Therefore, increasing alignment of the apertures 130A and 124B increases the flow out of the sprinkler 100 while decreasing alignment of the apertures 130A and 124B decreases the flow.

The throttle plate 130 is located below the drive plate 124 and includes center aperture 130B that engages with the mating lower end 116A of the flow adjustment shaft 116. In this respect, rotating the flow adjustment shaft 116 also rotates the throttle plate 130 relative to the drive plate 124.

The throttle plate 130 is frictionally engaged to the bottom of the drive plate 124, rotating the throttle plate 130 with the drive plate 124. For example, this frictional engagement could be caused by close proximity (contact) between the entire upper surface of the throttle plate 130 and lower surface of the drive plate 124. Additionally, the flow of water through the sprinkler 100 may cause slight movement and pressure of the throttle plate upwards against the drive plate 124, further increasing friction. The frictional or clutching force between the throttle plate 130 and the drive plate 124 is such that it can be overcome when the user adjusts the flow adjustment member 112 and therefore the flow of the sprinkler 100. Alternately, the frictional clutching of the throttle plate 130 can be achieved by contact with the upper end of the stator 132.

Figure 12:
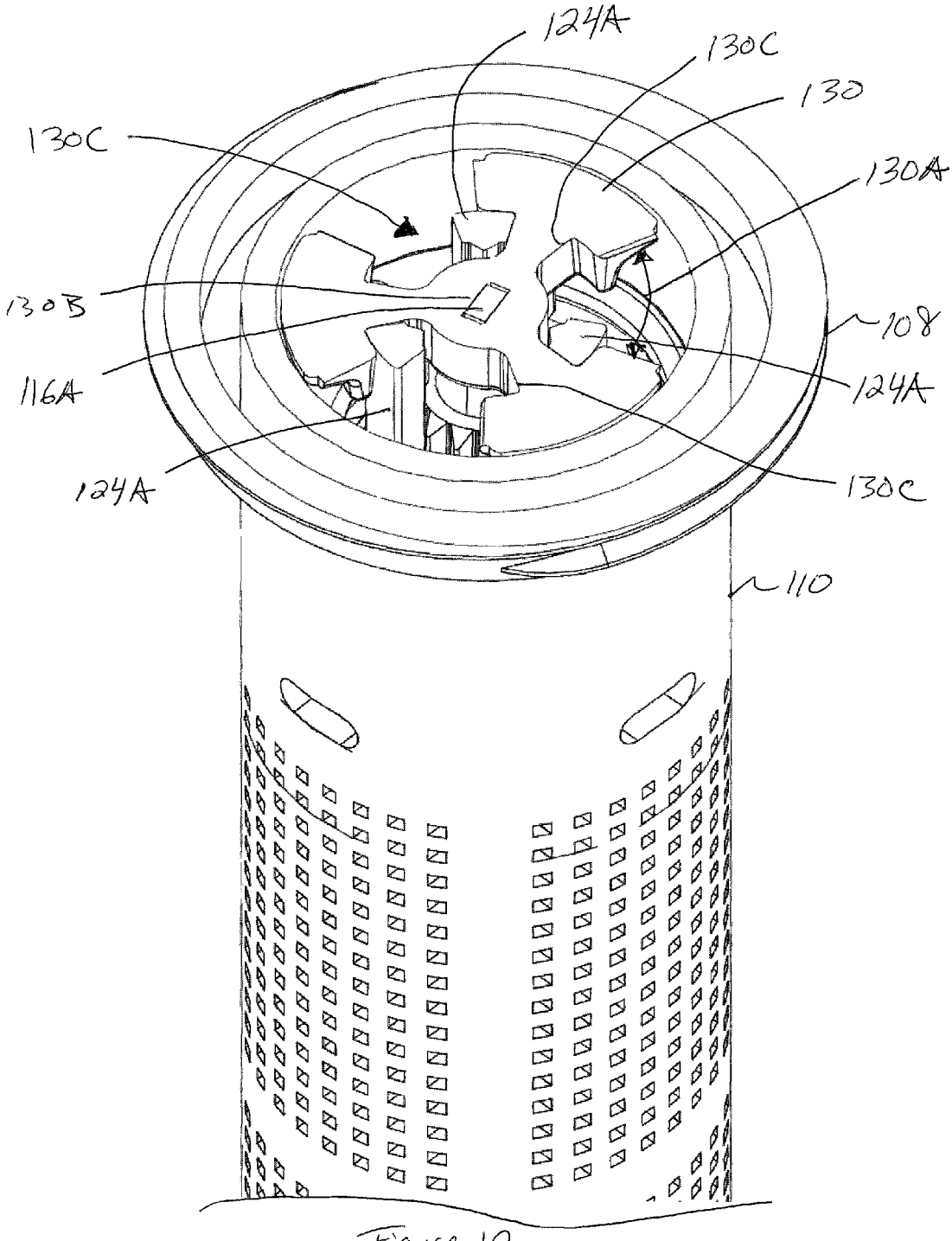
FIG. 12 illustrates a cross sectional view of the sprinkler of FIG. 1 along lines 12-12.
Figure 13:
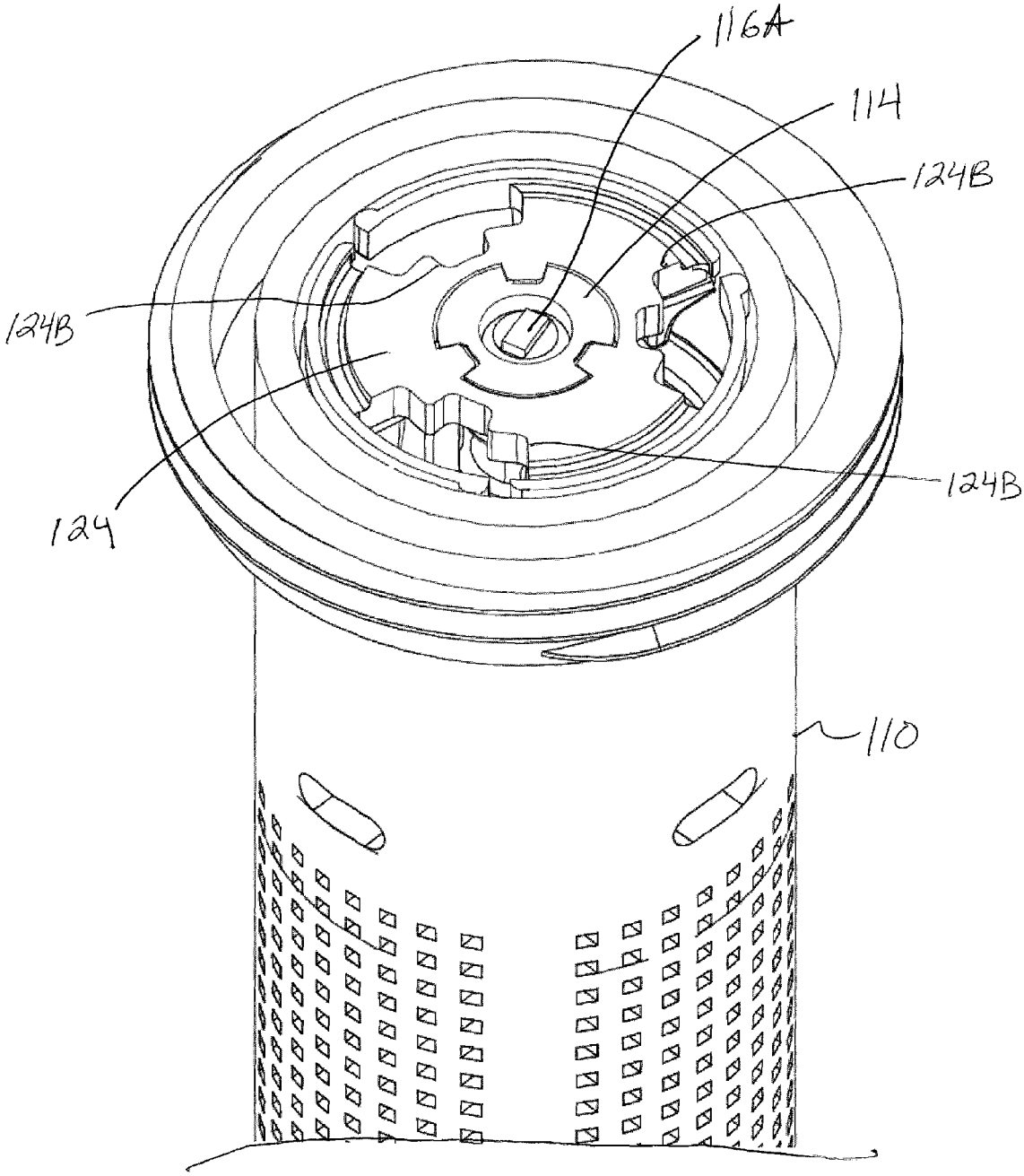
FIG. 13 illustrates a cross sectional view of the sprinkler of FIG. 1 along lines 13-13.

As best seen in FIG. 12, the throttle plate 130 includes spaces or inner apertures 130C that have a generally curved shape. These apertures are sized to allow the legs 124A of the drive plate 124 to pass through. In this respect, the legs 124A act as stops for the throttle plate 130, limiting rotational movement of the plate 130 to the length of the apertures 130C.

Figure 14:
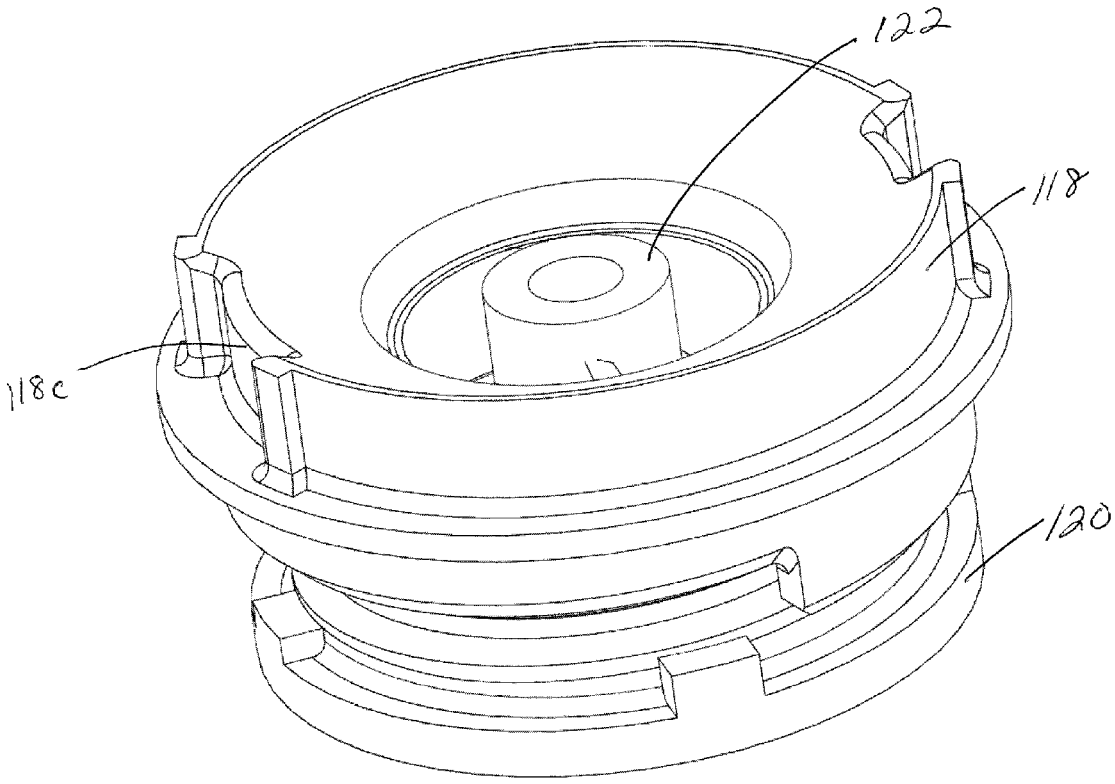
FIG. 14 illustrates a perspective view of an arc adjustment assembly according to a preferred embodiment of the present invention.

FIG. 14 illustrates the arc adjustment mechanism of the sprinkler 100 according to the present invention which increases or decreases the arc of water thrown from the sprinkler 100. The arc is adjusted by rotating a moving arc member 118 relative to a stationary arc member 120 and a center boss 122.

Figure 15:
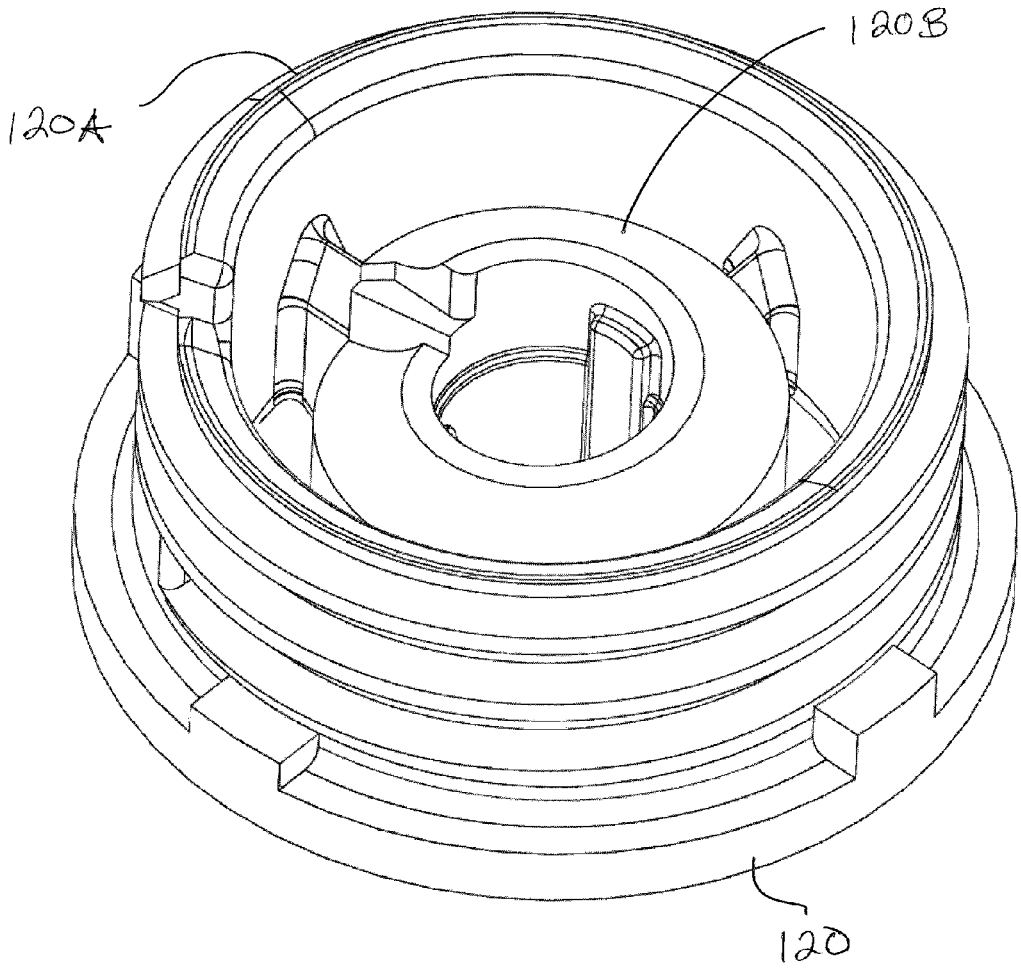
FIG. 15 illustrates a top perspective view of a stationary arc adjustment member according to a preferred embodiment of the present invention.

The stationary member 120, best seen in FIG. 15, includes a stepped, inner helical surface 120B and an outer helical surface 120A. Both surfaces 120A and 120B face towards the top of the sprinkler 100.

Figure 16:
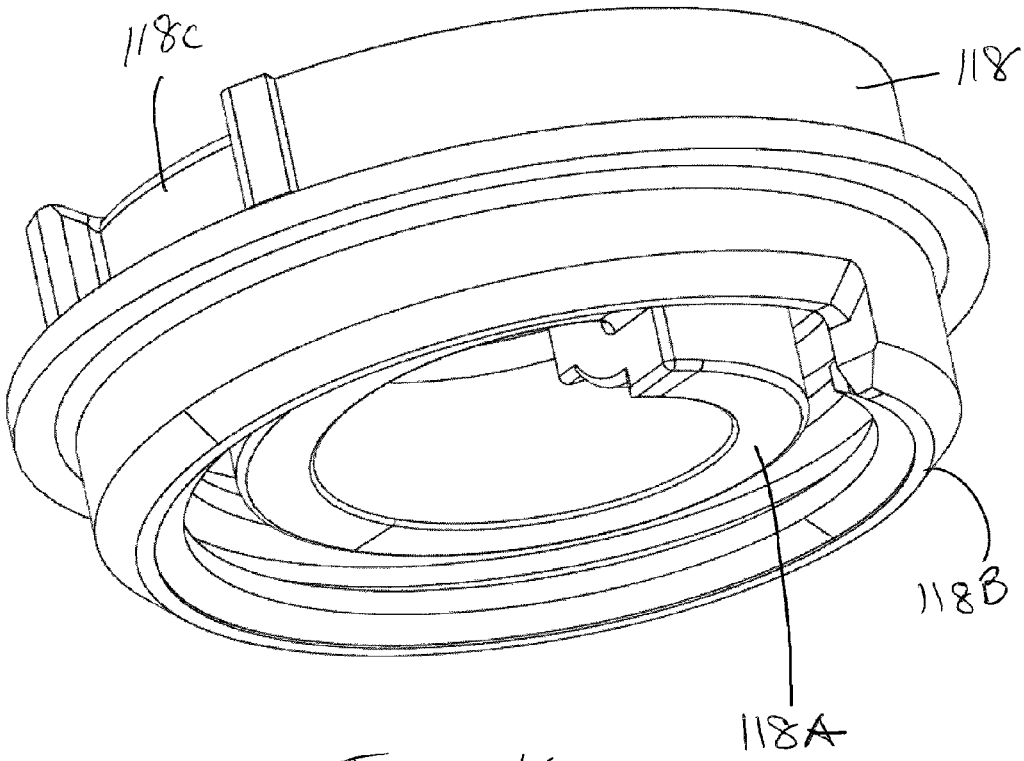
FIG. 16 illustrates a bottom perspective view of a moving arc adjustment member according to a preferred embodiment of the present invention.
Figure 17:
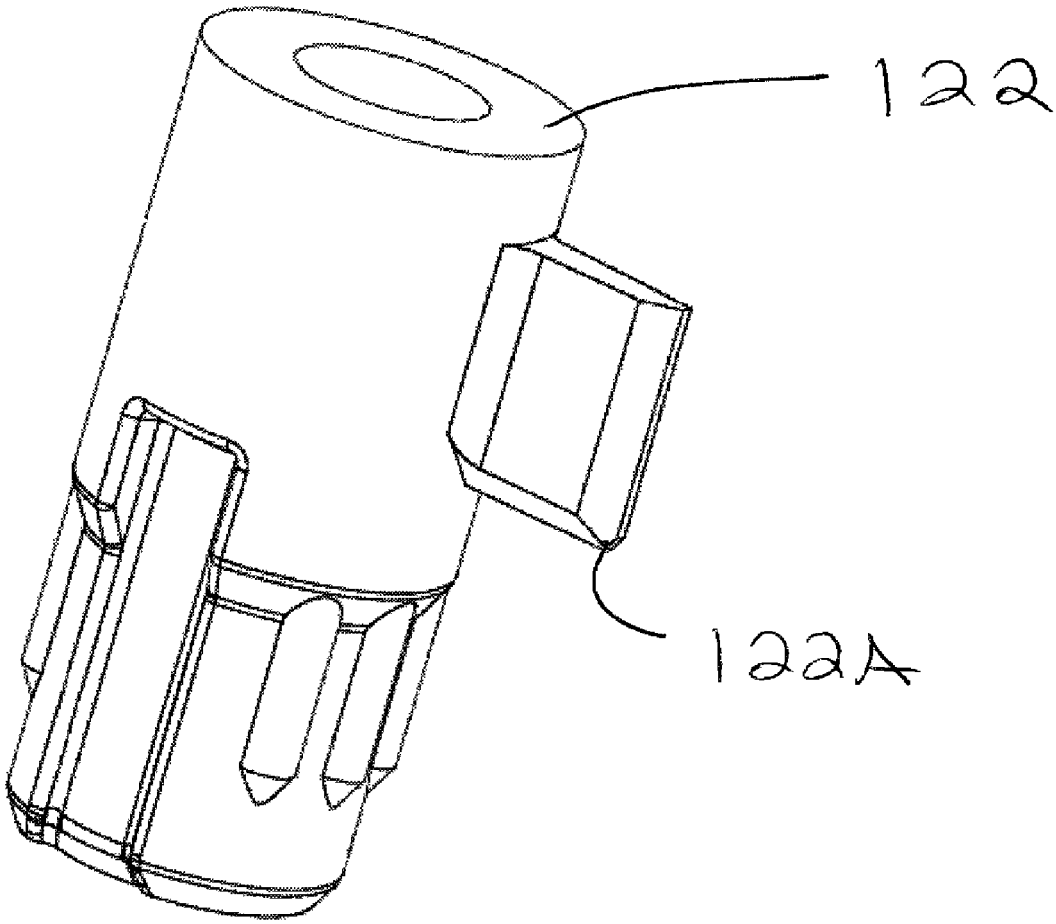
FIG. 17 illustrates a perspective view of a center boss according to a preferred embodiment of the present invention.

The moving arc member 118, best seen in FIG. 16, similarly includes a stepped, inner helical surface 118A and an outer helical surface 118A. Preferably, the slope or incline of these surfaces 118A and 118B are opposite the slope or incline of the surfaces 120A and 120B, however varying angles of each surface are also possible.

The center boss 122 is positioned within the center aperture of stationary member 120 and includes a fin 122A which provides a nonmoving end to the arced nozzle passage created between the moving arc member 118 and the stationary arc member 120.

Figure 18:
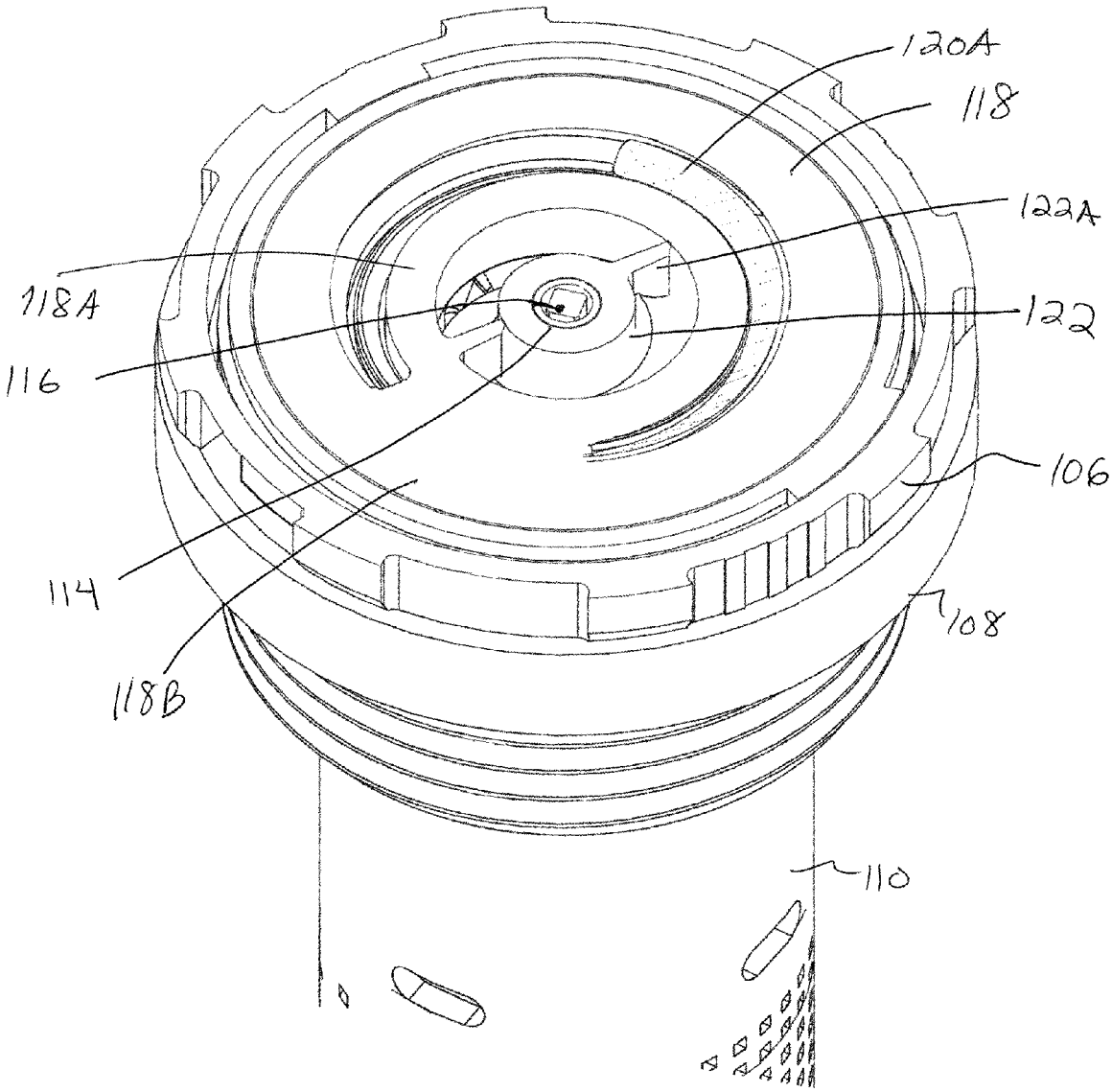
FIG. 18 illustrates a cross sectional view of the sprinkler of FIG. 1 along lines 18-18.
Figure 19:
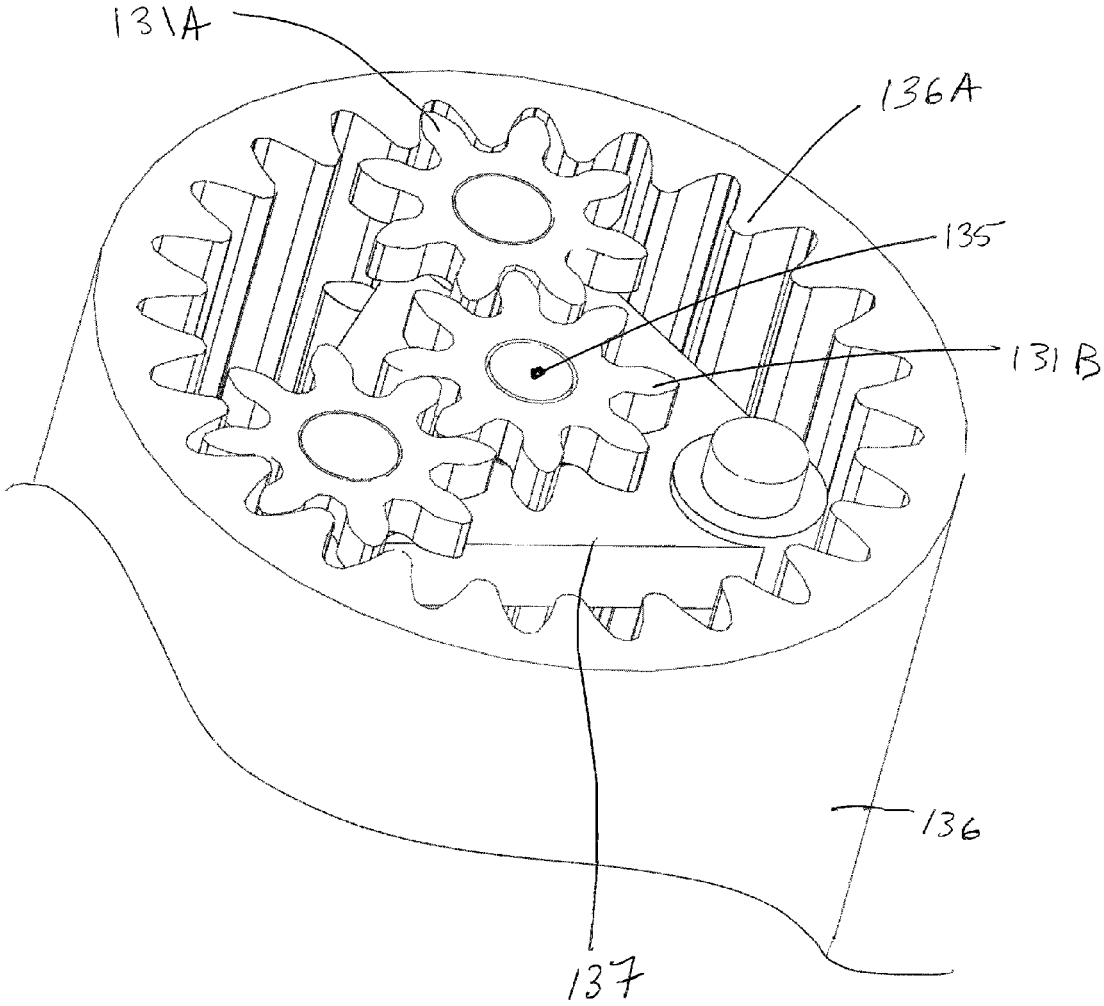
FIG. 19 illustrates a cross sectional perspective view of the sprinkler of FIG. 1 along lines 19-19.

As seen in FIG. 18, the surfaces 120A, 120B, 118A and 118B are positioned adjacent to each other, horizontally overlapping. When the smallest (i.e., shortest) portion of these surfaces 120A, 120B, 118A and 118B overlap, a gap is created through which water flows. When the largest (i.e., tallest) portion of these surfaces 120A, 120B, 118A and 118B overlap, the gap is decreased or even eliminated. In this respect, rotating the moving arc member 118 increases or decreases the arc-shaped gap and similarly the watering arc of the sprinkler 100. The moving arc member 118 is preferably connected to the stationary arc member 120 by threads on both members, allowing for rotation relative to each other.

Figure 23:
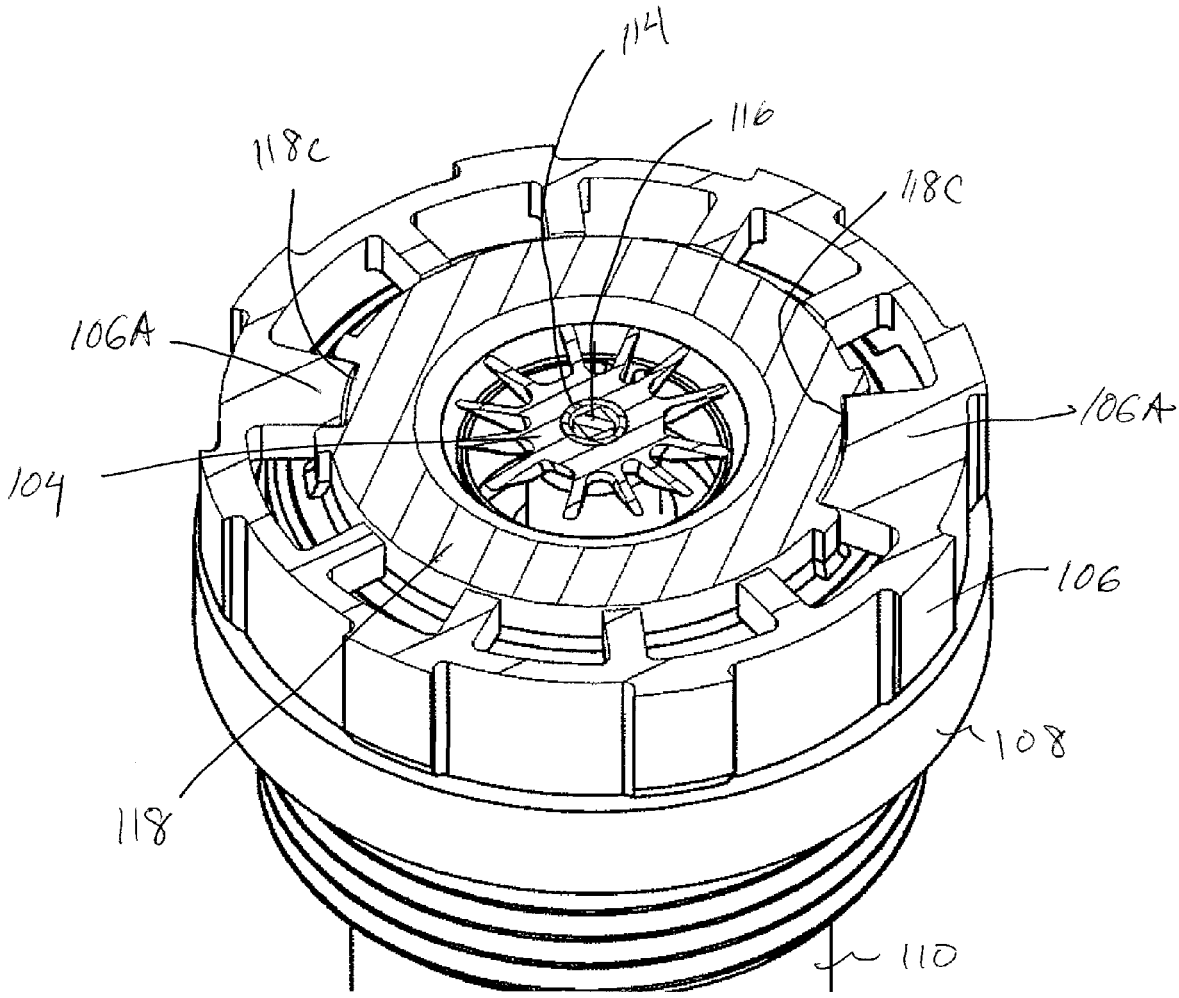

To allow for vertical movement of the moving arc member 118 during rotation (i.e., from rotating on the thread of the stationary arc member 120), the moving arc member 118 is "captured" by the arc adjustment member 106. In other words, the arc adjustment member 106 rotates the moving arc member 118 but allows for free vertical movement of the moving arc member 118. Preferably this captured arrangement is achieved with a capture member 106A (seen in FIG. 23) that mates with a channel 118C of the moving arc member 118 (see FIGS. 14 and 16). In this respect, the capture member 106A can rotate the moving arc member 118 as the channel 118 slides over the capture member 106A.

It should be noted that the horizontal placement of the surface 118A and 120A (i.e., the gap created by these surfaces) can be modified to adjust the flow of the water emitted from the sprinkler. For example, increasing the horizontal distance increases the overall flow of water emitted from the sprinkler 100, while decreasing the horizontal distance decreases the overall flow. Therefore, the overall water flow can be increased or decreased (in addition to the previously described, user adjustable flow control).

Alternately, the moving arc member 118 may be replaced with a nonmoving version that prevents a user from adjusting the watering arc. This allows the manufacture to specify popular pre-set arcs for users or create non-arc shaped watering patterns (e.g., a square watering pattern). Additionally, since the non movable member does not require a full inner helical surface 118A compared with the moving arc member 118 (because the non moving member does not rotate), the opening of the non moving member can be larger. This larger opening allows for more water to deflect off the deflector 104 and therefore be distributed around the sprinkler 100.

Figure 20:
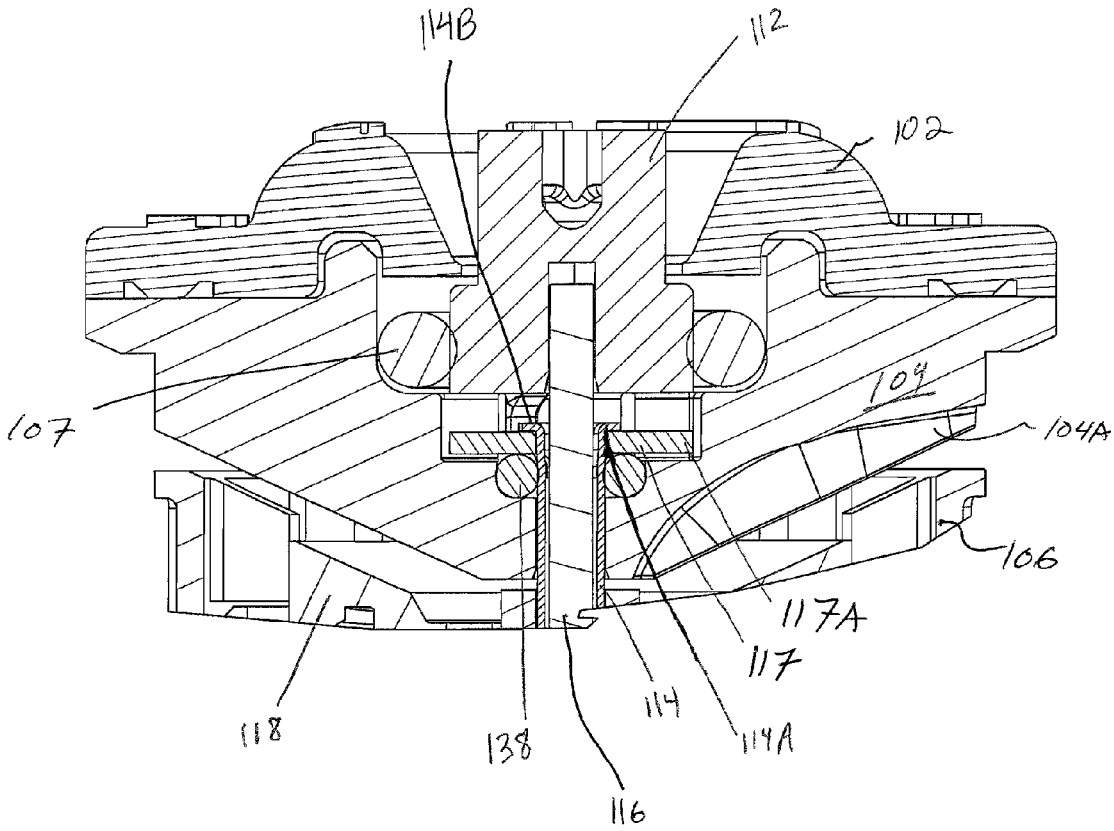
FIG. 20 illustrates a magnified cross sectional view of the sprinkler of FIG. 1.
Figure 21:
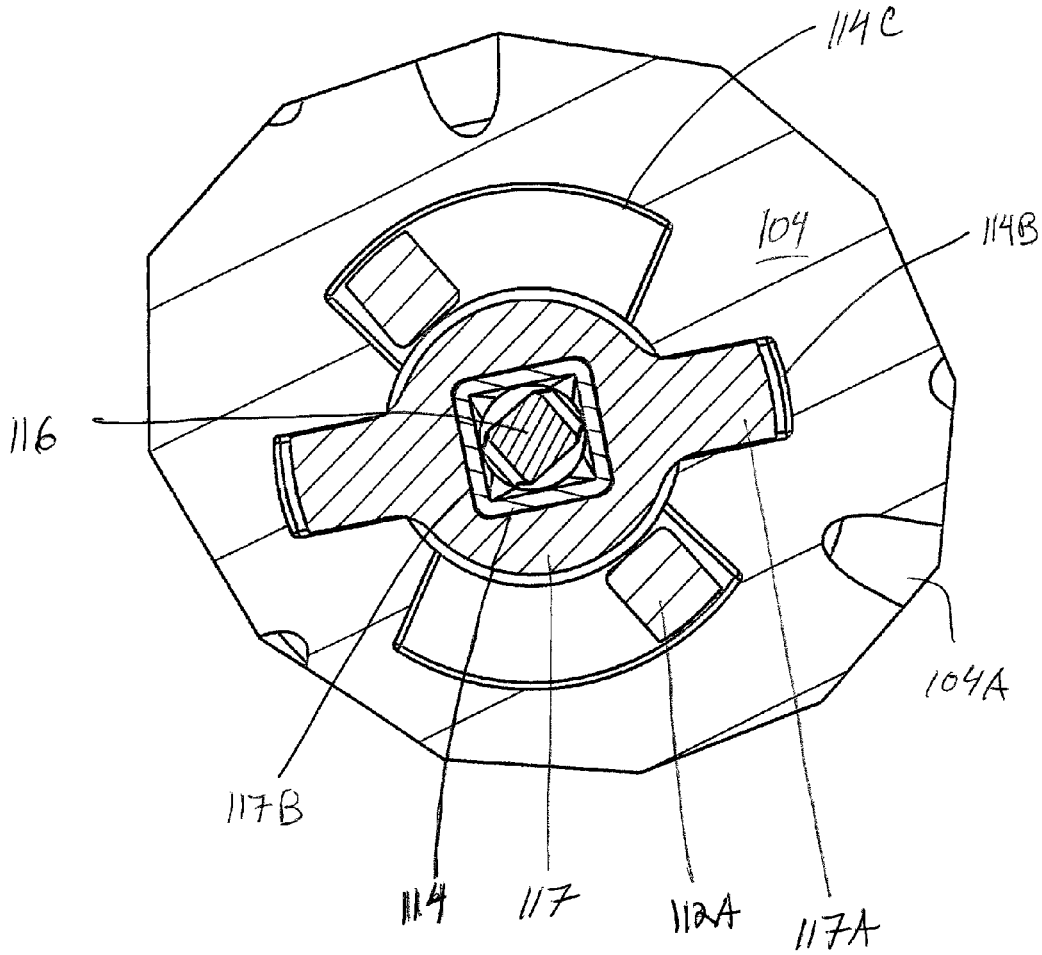
FIG. 21 illustrates a top sectional view of a portion of the deflector of the sprinkler of FIG. 1.

As best seen in FIGS. 20 and 21, the sprinkler 100 further includes a drive washer 117 which couples the deflector plate 104 to the drive shaft 114. The drive shaft 114 preferably includes a square, cross sectional shape 114A (seen best in FIG. 21) that fits within the square aperture 117B and is thereby "captured" by the square aperture 117B. The deflector plate 104 is prevented from upward movement by a flared portion 114B on the top end of the drive shaft 114. Additionally, the washer 117 includes fins 117A that are positioned into mating spaces 114B of the deflector plate 104 to prevent slipping between the washer 117 and the deflector plate 104.

Positioned below the washer 117 is O-ring 138. Additionally, O-ring 107 is located between the deflector plate 104 and the adjustment member 112. Preferably, the O-ring 138, as well as O-ring 107, is composed of rubber, silicone or a similar flexible, resilient material.

Since the O-ring 138 under the drive washer 117 and O-ring 107 is composed of a somewhat flexible material, the deflector plate 104 can wobble (i.e., can tilt slightly or rotate off-axis). In other words, O-rings 138 and 107 allow for some "give" or compression so that the deflector plate 104, if urged by a force, can tilt off its rotational axis. While this "wobble" would likely not be present during normal operation, it would allow the deflector plate 104 to "wobble" over dirt or debris trapped between the deflector plate 104 and moving arc member 118. Thus, debris that would have otherwise stopped or hindered the deflector plate 104 from rotation can be passed over, providing a greater chance that a moving stream of water will push the debris from the sprinkler 100.

Figure 22:
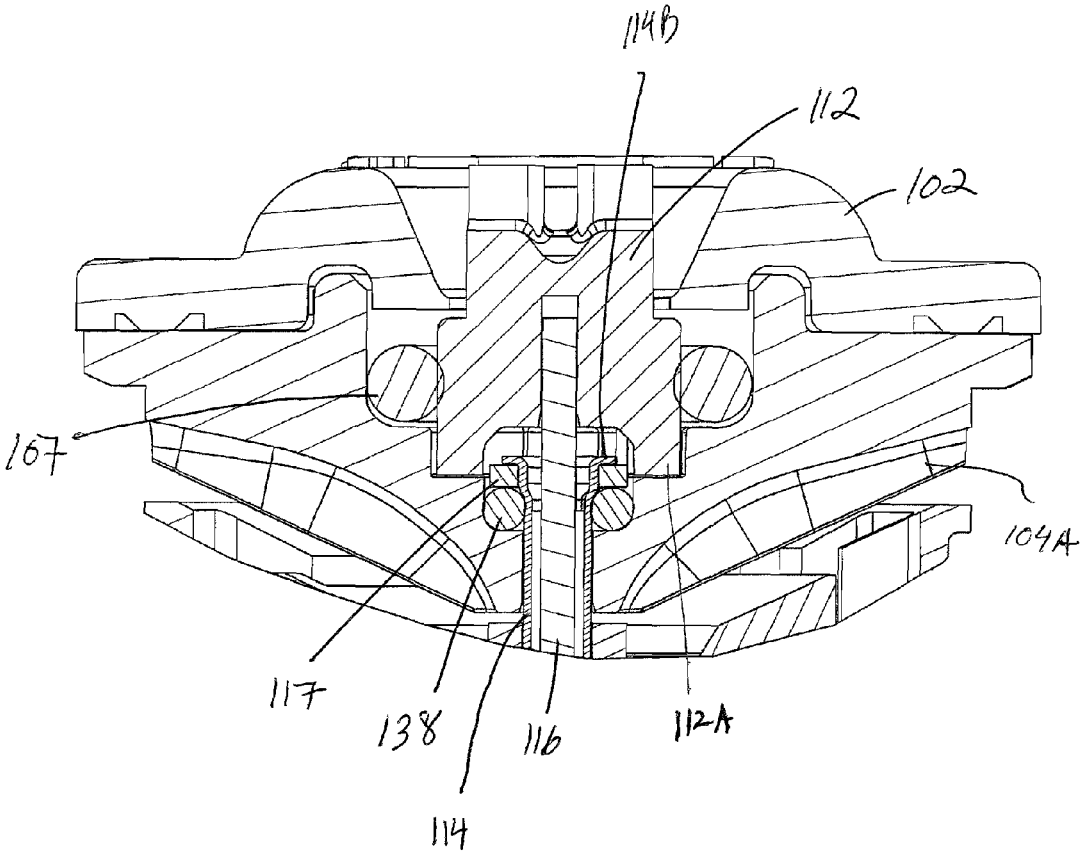
FIG. 22 illustrates a magnified cross sectional view of the sprinkler of FIG. 1; and, FIG. 23 illustrates a cross section view of the sprinkler of FIG. 1.

As best seen in FIGS. 21 and 22, the deflector plate 104 includes arc-shaped cavities 114C into which lower legs 112A of the arc adjustment member 112 are positioned. The elongated, arc shape of the cavities 114C restrict the degree of rotation of the arc adjustment member 112, preventing damage to other components of the sprinkler due to over-rotation.

As seen best in FIGS. 3-6, the sprinkler 100 further includes a backflow stop pin 123 that forms a valve to prevent water flow into the stator 132 and area surrounding the turbine 134 when the water supply to the sprinkler 100 is stopped. The backflow stop pin 123 has a generally solid funnel shape and is positioned over the top aperture of the stator 132. As shown in the figures, the backflow stop pin 123 is in an open position. However, when the water to the sprinkler 100 is stopped, the backflow stop pin 123 drops against the stator 126, preventing water from draining into the stator 132. In this respect, debris that may be in the water is prevented from moving into the stator 132 and hindering the performance of the turbine 134.

In operation, water flows through the screen 110 and into passages 132B, rotating the turbine 134 (or alternately bypassing the turbine through the bypass valve) and passing through apertures 130A and 124B. Finally, the water passes through the stationary arc member 120, the moving arc member 118 and deflects against the deflector plate 104 away from the sprinkler 100.

The rotating turbine 134 drives the rotation of the gears 131A and 131B within the gear assembly 136, rotating the outer case of the gear assembly 136. The gear assembly 136 rotates the stator 132, which rotates the drive plate 124. The drive plate 124 rotates the drive shaft 114, which ultimately rotates the deflector plate 104. The channels 104A within the deflector plate 104 create multiple water streams that move across the watering arc of the sprinkler 100.

The watering arc is adjusted by rotating the arc adjustment member 106 which rotates the moving arc member 118 and thereby opens or closes a gap between the moving arc member 118, the stationary arc member 120 and the center boss member 122.

The radius that the water is thrown from the sprinkler 100 (i.e., the water flow through the sprinkler 100) is adjusted by rotating the flow adjustment member 112 (e.g., by hand or with an adjustment tool). The flow adjustment member 112 rotates the flow adjustment shaft 116, causing the throttle plate 130 to overcome the friction with the drive plate 124. As the flow adjustment member 112 rotates relative to the drive plate 124, the apertures 130A and 124B move into or out of alignment, adjusting the water flow through the sprinkler 100.

As previously discussed, the flow adjustment member 112, the flow adjustment shaft 116 and the throttle plate 130 all rotate with the drive plate 124, drive shaft 114, deflector plate 104 and sprinkler cap 102 during normal operation. However, when the water flow is adjusted, as previously described, these components move relative to drive plate 124, drive shaft 114, deflector plate 104 and sprinkler cap 102 as the friction between the throttle plate 130 and drive plate 124 is overcome.

While a mini stream sprinkler has been specifically described, it should be understood that other sprinkler designs, such as rotating nozzle designs may also be used according to aspects of the present invention. Additionally, it should be noted that while the flow adjustment shaft 116 has been described as being within the drive shaft 114, an alternate arrangement is contemplated in which the drive shaft 114 is positioned within a passage of the flow adjustment shaft 116.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A sprinkler comprising:

a deflector rotatably disposed at a top region of said sprinkler for deflecting water away from said sprinkler;

a drive mechanism driven by a flow of water in said sprinkler;

an adjustment mechanism at least partially disposed within said sprinkler;

a first shaft coupled to said drive mechanism and said deflector so as to drive rotation of said deflector; and a second shaft coupled to said adjustment mechanism and an adjustment member at said top region of said sprinkler for allowing a user to engage and rotate said adjustment mechanism;

wherein said second shaft is disposed within said first shaft.

2. The sprinkler of claim 1, wherein said adjustment mechanism comprises a flow adjustment mechanism configured to modify a rate of water flow through said sprinkler.

3. The sprinkler of claim 1, further comprising a first member coupled to a lower end of said first shaft and a second member coupled to a lower end of said second shaft.

4. The sprinkler of claim 3, wherein said first member and said second member are driven to rotate by said drive mechanism.

5. The sprinkler of claim 4, wherein said second member is user-rotatable relative to said first member.

6. The sprinkler of claim 5, wherein user movement of said second member repositions spaces in said second member relative to said first member to increase or decrease flow of water through said first member and said second member.

7. The sprinkler of claim 6, wherein said deflector includes a plurality of grooves.

8. The sprinkler of claim 7, further comprising an arc adjustment mechanism comprising a movable arc member having a first helical surface and a stationary arc member having a second helical surface.

9. The sprinkler of claim 8, wherein said first helical surface is disposed adjacent to said second helical surface.

10. A sprinkler comprising:

a sprinkler body having a passage extending along a length of said body;

a deflector rotatably disposed at a top end of said passage for deflecting water away from said sprinkler;

a turbine coupled to an arrangement of gears for driving rotation of said deflector;

a first elongated member extending at least partially along said length of said body and coupled to said arrangement of gears and said deflector;

a second elongated member extending at least partially along said length of said body and coupled to an adjustment mechanism; said second elongated member at least partially located within said first elongated member;

said first elongated member and said second elongated member rotating together during a normal operation of said sprinkler; and said second elongated member selectively rotatable by a user relative to said first elongated member for adjusting said adjustment mechanism.

11. The sprinkler of claim 10, wherein a first end of said second elongated member is coupled to a first flow adjustment member disposed near a second flow adjustment member and wherein said second flow adjustment member is frictionally engaged with said first flow adjustment member.

12. The sprinkler of claim 11, further comprising a drive washer disposed around said second elongated member and engaged with said deflector and a flexible member disposed under said drive washer so as to allow said deflector to rotate off-axis.

13. The sprinkler of claim 11, wherein said first flow adjustment member, said second flow adjustment member, said first elongated member, said second elongated member and said deflector are rotationally driven by said arrangement of gears.

14. The sprinkler of claim 13, wherein said second flow adjustment member is movable by a user relative to said first flow adjustment member so as to increase or decrease a passage between said first flow adjustment member and said second flow adjustment member.

15. The sprinkler of claim 14, wherein said second flow adjustment member is rotatable by a user from a top surface of said sprinkler.

16. A sprinkler comprising:

a sprinkler body have a passage extending through a length of said body;

a first shaft disposed within said passage and connected to a flow adjustment mechanism;

a second shaft disposed around said first shaft and connected to a drive mechanism; and a clutch engaged between said first shaft and said second shaft;

wherein said clutch can be selectively disengaged to allow independent rotation of said first shaft relative to said second shaft.

17. The sprinkler of claim 16, wherein said first shaft and said second shaft rotate together when said clutch is engaged and wherein said clutch is disengageable by a user to cause independent rotation of said first shaft and said second shaft.

18. The sprinkler of claim 17, wherein said second shaft is coupled to a turbine driven gear system and a rotatable deflector.

19. The sprinkler of claim 18, wherein said first shaft is coupled to a tool member; said tool member shaped for engagement with a tool.

20. The sprinkler of claim 19, further comprising a bypass valve positioned to allow water to selectively bypass said turbine driven gear system.

21. The sprinkler of claim 16, further comprising a drive washer disposed around said second shaft and engaged with a deflector plate and a flexible member disposed under said drive washer so as to allow said deflector plate to rotate off-axis.

22. The sprinkler of claim 16, further comprising a gearbox disposed in said sprinkler body and a turbine coupled to a top end of said gearbox.

23. The sprinkler of claim 16, further comprising a backflow valve member positioned to allow passage of water in a first direction and prevent passage of water into an area around a turbine of said sprinkler.

* * * * *